US005542840A

United States Patent [19]

Surbey et al.

[11] Patent Number: 5,542,840

[45] Date of Patent: Aug. 6, 1996

[54] BURNER FOR COMBUSTING GAS AND/OR LIQUID FUEL WITH LOW $NO_x$ PRODUCTION

[75] Inventors: David J. Surbey; James L. Smith, both of Tulsa; Richard C. Allen, Catoosa; Alan D. Witwer, Tulsa, all of Okla.

[73] Assignee: Zeeco Inc., Tulsa, Okla.

[21] Appl. No.: 538,621

[22] Filed: Oct. 4, 1995

Related U.S. Application Data

[63] Continuation-in-part of Ser. No. 187,172, Jan. 26, 1994, Pat. No. 5,458,481.

[51] Int. Cl.[6] ..... F23M 3/00

[52] U.S. Cl. ..... 431/116; 431/177; 431/174

[58] Field of Search ..... 431/115, 116

[56] References Cited

U.S. PATENT DOCUMENTS

| | | | |
|---|---|---|---|
| 2,174,663 | 10/1939 | Keller | 126/109 |
| 2,918,117 | 11/1959 | Griffin | 158/1 |
| 4,004,875 | 1/1977 | Zink et al. | 431/9 |
| 4,162,140 | 7/1979 | Reed . | |
| 4,277,942 | 7/1981 | Egnell et al. . | |
| 4,476,791 | 10/1984 | Cegielski, Jr. . | |
| 4,483,832 | 11/1984 | Schirmer . | |
| 4,505,666 | 3/1985 | Martin et al. . | |
| 5,073,105 | 12/1991 | Martin et al. . | |
| 5,180,300 | 1/1993 | Hovis et al. . | |
| 5,284,438 | 2/1994 | McGill et al. . | |

*Primary Examiner*—Carroll B. Dority
*Attorney, Agent, or Firm*—Head Johnson & Kachigian

[57] ABSTRACT

A burner for combusting gas and/or liquid fuel and air in an enclosure includes a burner block of non-combustible material, such as ceramic material, having a central opening therethrough communicating with a combustion zone. The burner block has a plurality of spaced apart recirculation gas passageways paralleled to and spaced from the central opening, each of the recirculation gas passageways having an injection passageway communicating with the block member central opening. Fuel, which may be liquid and/or gas, is injected into said burner block central opening. Venturi action causes furnace gas to be drawn from the cool fringes of the combustion zone through the recirculation gas passageways for passage back into the central opening wherein air and fuel are thoroughly mixed and cooled for combustion within the enclosure. This recirculation system serves to reduce the temperature and oxygen content of the local combustion process to thereby reduce $NO_x$ production. An annular flame director ring positioned within the burner block central opening adjacent to and below the injection passageways augments the Venturi action to increase flow through the recirculation passageways.

17 Claims, 14 Drawing Sheets

EQUILIBRIUM $NO_x$ CONCENTRATION

*(PRIOR ART)*

ADIABATIC FLAME TEMPERATURE
*(PRIOR ART)*

HEATER ISOTHERMS (°F)
*(PRIOR ART)*

COMBUSTION PROCESS TEMPERATURE AND RELATIVE OXYGEN

BURNER FOR COMBUSTING GAS AND/OR LIQUID FUEL WITH LOW $NO_x$ PRODUCTION

CROSS-REFERENCE TO RELATED APPLICATION

This is a continuation-in-part application of U.S. patent applcition Ser. No. 08/187,172 filed Jan. 26, 1994, now U.S. Pat. No. 5,458,481 and "An Improved Burner For Combusting Gas With Low $NO_x$ Production".

BACKGROUND OF THE INVENTION

This invention relates to a burner for combusting air and fuel characterized in that the fuel is thoroughly mixed on a local basis with modified combustion air in a manner so that resultant combustion is complete and oxides of nitrogen ($NO_x$) in the exhaust gas are substantially reduced. "Fuel" as used herein means gas and/or liquid fuel.

Fuel is burned by mixing air with it, oxygen from the air being combined with carbon and hydrogen present in the fuel with the release of substantial heat. If fuel is thoroughly mixed with air and combustion is carried out under ideal conditions the results of the combustion are primarily carbon dioxide and water in vapor form. These components are commonly found in the atmosphere and are essentially free of hazard to the environment. However, when fuel is burned at a high temperature, excess air environment, a portion of the nitrogen, which makes up a major component of the atmosphere, will react with oxygen in the atmosphere to produce oxides of nitrogen ($NO_x$). It is well known that, other conditions being equal, $NO_x$ production increases as the temperature of the combustion process increases. Oxides of nitrogen gases are considered to be an environmental hazard.

The present invention is an improved burner for combusting fuel, whether a gas or a liquid or a combination of both, with modified air in a manner to result in less $NO_x$ than is available by the present generation of burners. The present generations of burners are commonly referred to as "Low $NO_x$ Burners" or "Low NOx Burners".

For background information relating to burners configured to reduce $NO_x$ production, reference may be had to the following U.S. Pat. Nos. 4,505,666; 4,483,832; 4,162,140; 5,284,438; 5,180,300; 4,004,875; 5,073,105 and 2,918,117 which are incorporated herein by reference.

SUMMARY OF THE INVENTION

The present invention is formed, in a first embodiment in which the fuel is gas only, by a hollow cylindrical block (burner block) normally formed of ceramic material. The burner block has an inlet and an outlet end. The outlet end is positioned in communication with the interior of an enclosure to be heated by burning gas. The enclosure may be such as a fired heater, boiler, furnace or the like. The objective of the burner is to cause combustion of fuel gas in a low temperature modified air environment to thereby reduce the generation of $NO_x$.

The burner block has a plurality of recirculation gas passageways spaced apart and extending a portion of and/or the full length of the burner block between the block inlet and outlet ends. The recirculation gas passageways are paralleled to and spaced from the center line of the cylindrical block. Each of the recirculation gas passageways has connected to it an injection passageway communicating each recirculation gas passageway with the central opening.

A primary fuel gas jet tip is positioned within each of the recirculation gas passageways for injecting fuel gas into the injection passageways. This causes the injected fuel gas to pass into the central opening where it is mixed with air. In addition, cool furnace gas, i.e. recycle gas, is drawn through the recirculation gas passageways for passage back to the injection passageways where it mixes with the fuel and then the mixture combines with air in the central opening.

Thus, the design of the recirculation gas passageways and the injection passageways in conjunction with the orientation of a fuel gas jet positioned in each of the recirculation gas passageways causes the recycle gas to thoroughly mix and intimately combine with the fuel gas causing a reduction in the temperature at which combustion takes place. Under the above conditions the resultant combustion is complete without the production of excessive oxides of nitrogen.

Positioned within the central opening are gas directors. The gas directors are adjacent the central opening and in alignment with each of the injection passageways. The gas directors are arranged to separate the local combustion of the fuel gas mixed with recycled gas from the main body of air and to cause a mixing action of the local combustion products before passing into the central opening. The gas directors are positioned adjacent the central openings so that the center part of the central opening remains unobstructed for the free passage of the main body of air therethrough.

Secondary fuel jet openings are also provided in the burner block. The openings are paralleled to and spaced between the recirculation gas passageways. Each secondary fuel jet opening in the burner block has a fuel gas conduit having affixed at the end thereof a gas jet tip extending slightly beyond the outlet end surface of the block and arranged to inject fuel gas across the burner block outlet end surface in a plurality of directions.

The burner block is preferably formed of two portions, that is, an inlet cylindrical portion and a frustoconical outlet portion having an angle ranging from outwardly diverging to inwardly converging. The inlet cylindrical portion outlet is in communication with the frustoconical outlet portion inlet.

A tubular skirt is concentrically positioned adjacent the inlet end of the block and provides means for controlling the passage of air into the burner block central opening.

A fuel gas manifold is positioned in close proximity to the tubular skirt and provides means for communication with each of the fuel gas conduits extending to the gas jet tips. The manifold has a fuel gas supply conduit extending from it.

The burner is configured to extend within the confines of an enclosure of the types previously mentioned. A ceramic insulating material may be provided between the enclosure and the burner block to a depth of at least substantially equal to the length of the burner block.

In an alternate embodiment of the burner configured to use gas only as a fuel, an annular flame director ring is positioned within the burner block central opening, the ring being planar and positioned immediately below the injection passageways in the direction towards the burner block inlet end. The flame director ring has an internal opening that is of less diameter than the burner block central opening. Supported on the flame director ring are flame directors that are each preferably arranged to be in alignment with an injection passageway. The flame directors are arranged so that gas drawn into the burner block central openings through the injection passageways will be caused to swirl within the central opening.

The annular flame director ring serves the dual purpose of providing means to support the flame directors and, in addition, functions to create a Venturi effect to augment the recirculation of gas through the recirculation gas passageways and injection passageways back into the central opening in the burner block. The Venturi effect achieved by the flame director ring is present if air is drawn into the burner block central opening by convection but is particularly important when forced draft is employed, that is, when air is forced into the inlet end of the burner block central opening.

The alternate embodiment of the invention as illustrated and described herein includes a modification of the external configuration of the burner block. In this modification, the external diameter of the burner block is reduced adjacent to the outlet end to form a burner block circumferential ledge. The spacing between the burner block inlet end and the circumferential ledge is less than the spacing between the burner block inlet and outlet ends. The recirculation gas passageways communicate with the circumferential ledge and therefore are of less length than the entire length of the burner block. This design of the burner block increases recirculation of gas due to the shorter length of recirculation gas passageways and further serves to isolate the inlet or upper end of each of the recirculation gas passageways from the outlet end of the burner block central opening so that thereby cooler gas is recirculated in the burner block central opening.

Another important improvement of the burner of this disclosure is the arrangement wherein the burner can be employed to burn liquid fuel only or a combination of liquid fuel and gas. To provide for combustion of liquid fuel, an oil gun is supported below the burner block and concentric with the burner block central opening. The oil gun has a liquid fuel nozzle that extends within the burner block central opening and preferably at an elevation with respect to the burner block substantially in line with the injection passageways.

To further augment the Venturi effect achieved by the flame director ring, when the burner is designed to use a liquid fuel or a combination of liquid and gas fuel and therefore has an oil gun as a portion thereof, the oil gun is provided with a diffuser cone at the upper end thereof, immediately below the liquid fuel nozzle. The diffuser cone is preferably co-planar with the flame director ring. The external diameter of the diffuser cone is less than the internal diameter of the flame director ring providing an annular area therebetween through which air flows into the lower end of the burner block central opening. The diffuser cone in combination with the flame director ring serves to create an increased Venturi effect to thereby increase the recirculation of gas through the recirculation and injection passageways.

When a burner is specifically designed for burning liquid fuel, whether alone or in combination with gaseous fuel, the use of a primary block in conjunction with the burner block has advantages. The primary block formed of ceramic material and is of external diameter less than the burner block central passageway. The primary block has an inlet end and an outlet end and is supported concentrically within the burner block central passageway with the outlet end substantially co-planar with the annular flame director ring positioned within the burner block central opening. The primary block has openings in the inlet end including a central opening into which the nozzle portion of an oil gun is positioned. Liquid fuel injected into the central opening in the primary block is mixed with air flowing into the inlet end of the primary block and is further mixed with air as the fuel passes out of the primary block into the interior of the burner block. The primary block helps support primary combustion. After being heated it additionally functions as a regenerating tool. That is, after being heated to liquid fuel ignition temperature, the burner flame is regenerated by the latent heat of the primary block. In addition, the primary block in conjunction with the flame director ring, augments the Venturi effect previously discussed to increase recirculation of gases through the recirculation and injection passageways to reduce $NO_x$ production.

A more complete understanding of the inventive subject matter disclosed herein will be obtained from reference to the following description of the preferred embodiments taken in conjunction with the attached drawings.

BRIEF DESCRIPTION OF THE DRAWINGS

FIG. 3 is a reproduction of a drawing taken from U.S. Pat. No. 4,476,791.

FIG. 5 is an end view of the improved burner of this invention as it would be seen from the inside of an enclosure, such as a fired heater, a boiler, a furnace or the like.

DETAILED DESCRIPTION OF THE PREFERRED EMBODIMENTS

Before discussing the improved burner for combusting fuel gas in a low temperature/modified air environment with low $NO_x$ production which is the subject of this disclosure, some background information will be helpful to enable the reader to fully understand the important concepts of the new burner.

Figure 1:
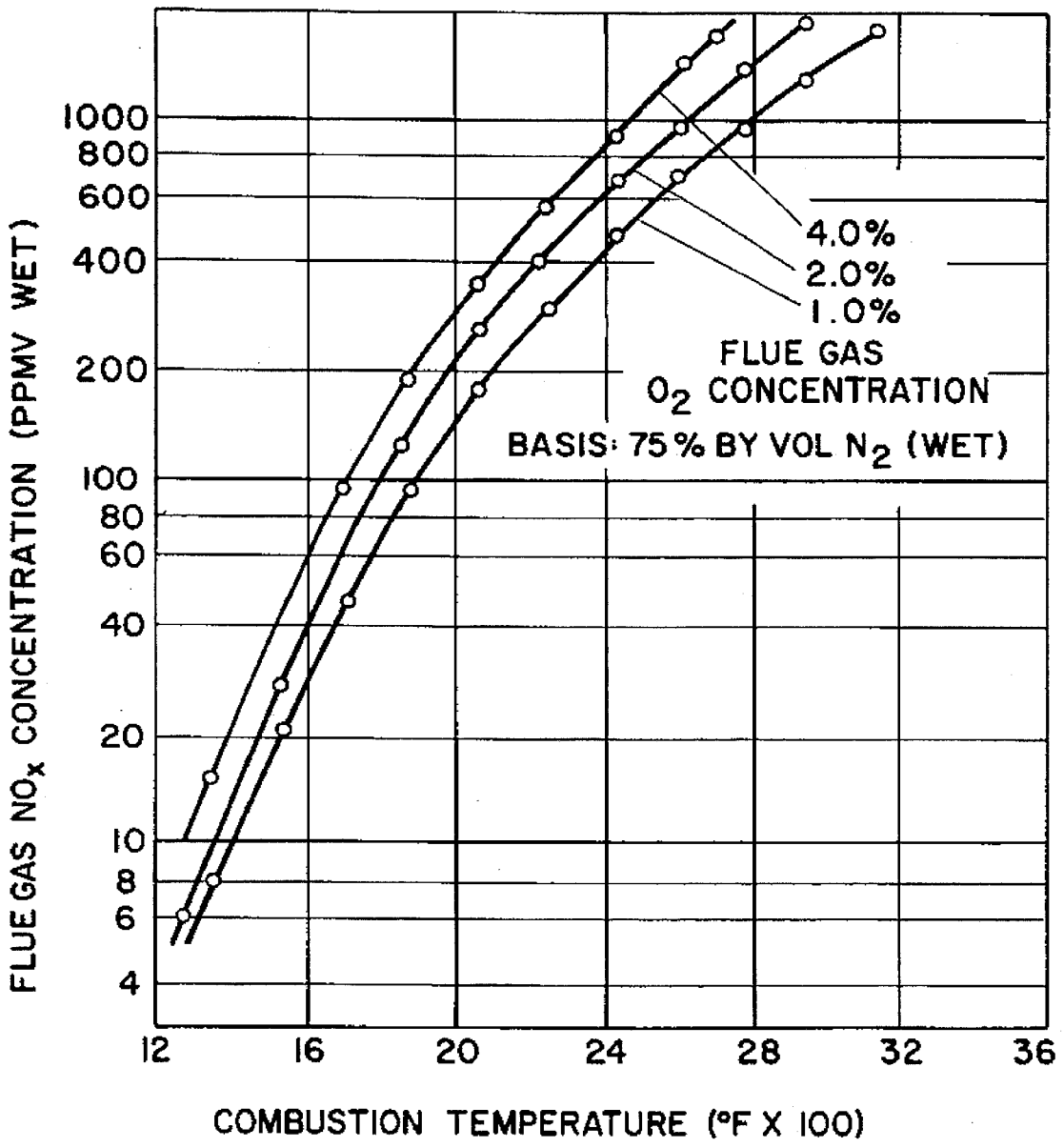
FIG. 1 is a graph showing flue gas equilibrium $NO_x$ concentration versus combustion temperatures under varying flue gas $O_2$ concentrations.

FIG. 1, entitled "Equilibrium $NO_x$ Concentration", illustrates the relationship between flue gas $NO_x$ concentration and the two parameters: (a) combustion temperature and (b) flue gas oxygen concentration. The flue gas $NO_x$ concentration is shown to increase as $O_2$ concentration increases at a fixed combustion temperature and as combustion temperature increases at a fixed $O_2$ concentration. The graph also illustrates that the inverse is also true, that is, as both combustion temperatures and $O_2$ concentrations decrease in value, so does flue gas $NO_x$ concentrations at a fixed $O_2$ concentration and combustion temperature respectively.

Figure 2:
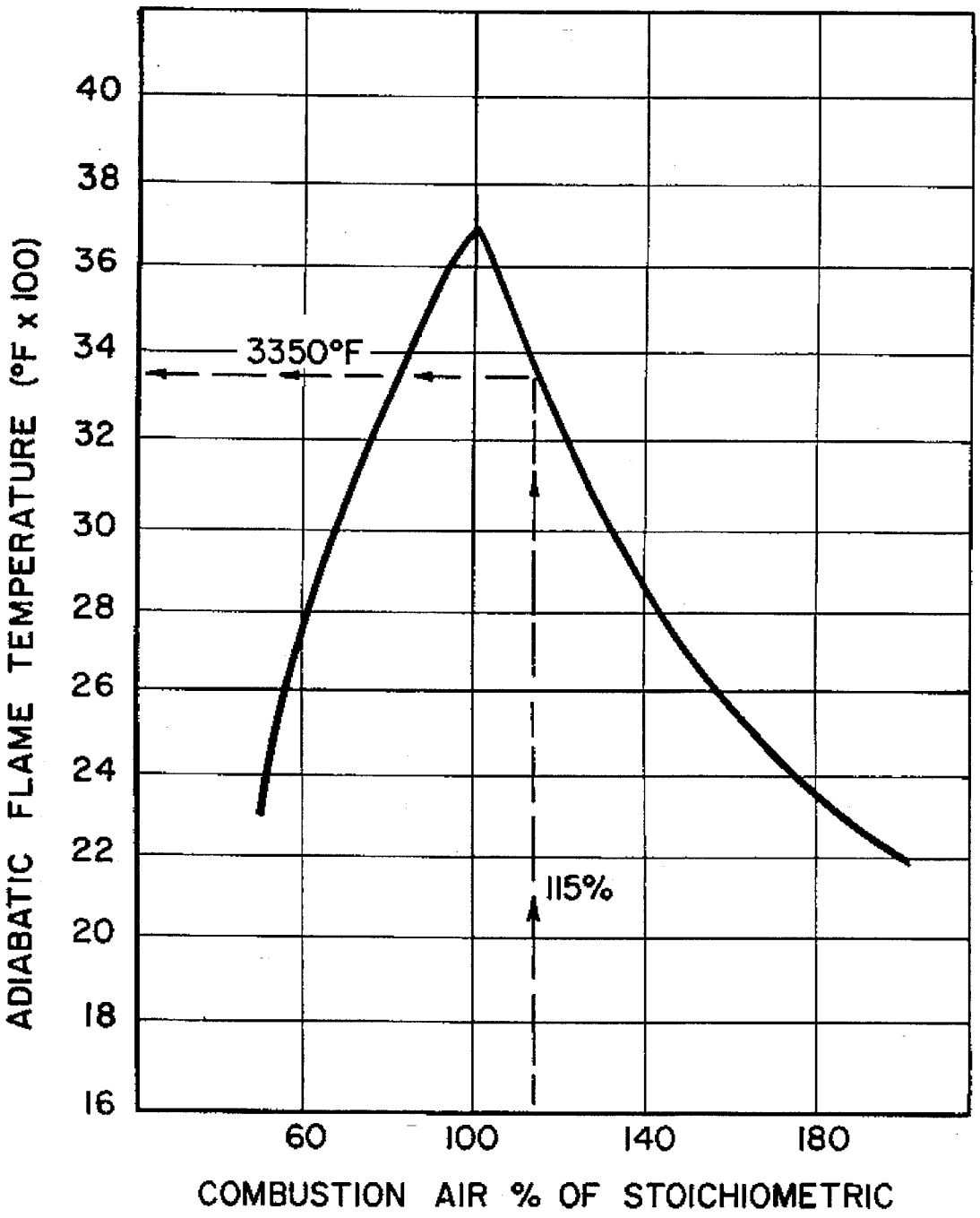
FIG. 2 is a graph showing the relationship in a burner of the adiabatic flame temperature versus the combustion air as a percentage of stoichiometric air.

It must be noted that in this graph $NO_x$ values given are equilibrium values which are never achieved in a real, short time duration, combustion process. For example, the combustion of methane with 15% excess combustion air (115% of stoichiometric) produces a theoretical adiabatic flame temperature of approximately 3350° F. as shown by FIG. 2 entitled "Flame Temperature". A 15% excess combustion air rate results in a flue gas oxygen concentration of approximately 2.5% on a wet basis. Using these parameter values in FIG. 1 results in an off scale reading which means the flue gas $NO_x$ concentration exceeds 1000 PPMV.

Actual flue gas $NO_x$ concentrations are much less than 1000 PPMV, because an equilibrium concentration is never achieved. The kinetics for the $N_2+O_2 \rightarrow NO_x$ chemical reaction is slow, relative to that required for equilibrium. However, it should be noted that as the temperature of the combustion process increases, the difference between equilibrium and actual flue gas $NO_x$ concentration decreases.

A 15% excess combustion air rate, or thereabouts, is close to a minimum value required for efficient burning of the combustible components of the fuel gas. This threshold value will ensure that the Hydrogen ($H_2$) in the fuel gas will convert to $H_2O$ and the Carbon (C) to $CO_2$, which means that the concentration of unburned Hydrocarbon (UHC) and Carbon Monoxide (CO) in the flue gas will be environmentally safe.

Combustion of fuel gas should occur at the lowest possible temperature to reduce $NO_x$ production. Use of a cooling medium, such as steam, water, or recycle gas can be employed to lower the combustion temperature. However, both water and steam decrease the amount of heat available for heat recovery.

Figure 3:
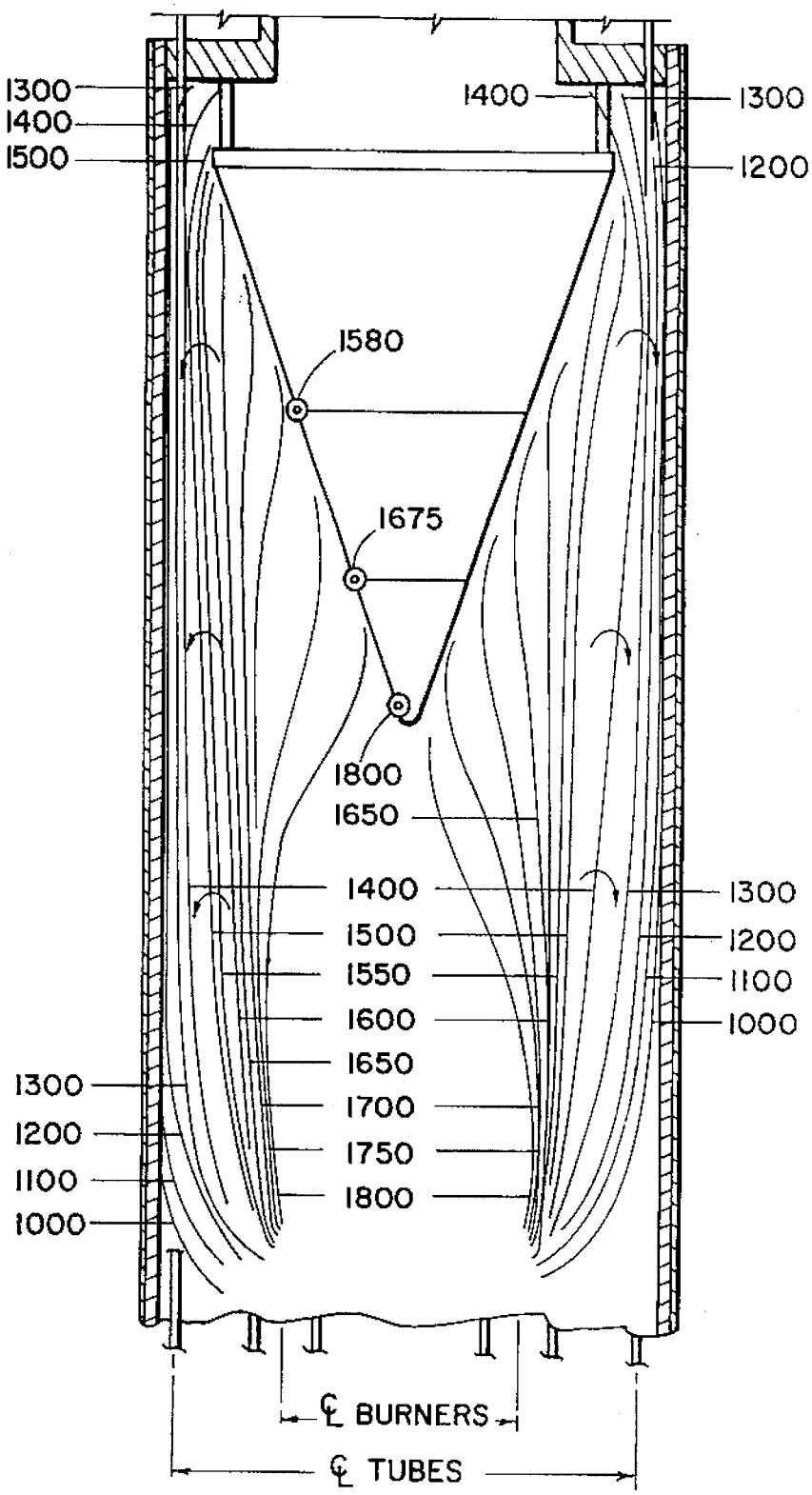
FIG. 3 is a cross-sectional view of a typical burner application showing the relative temperatures within a heat recovery enclosure illustrated by isotherms in degrees Fahrenheit. This Figure shows how temperatures can vary widely at different locations therein.

FIG. 3 is a schematic showing heater flue gas isotherms and is an example of the temperature profile present in a fired heat recovery enclosure such as those discussed. This Figure is taken from U.S. Pat. No. 4,476,791 which is incorporated herein by reference. Note that in the area of the burner(s), flue gas at a temperature of approximately 1000° F. is present for use to cool the combustion process. Additionally, it should be noted that the addition of this flue gas (containing substantially less than 21% $O_2$) to the combustion process would reduce the oxygen present in the local (primary) combustion process, but not the overall excess air ($O_2$) in the entire combustion process.

Figure 4:
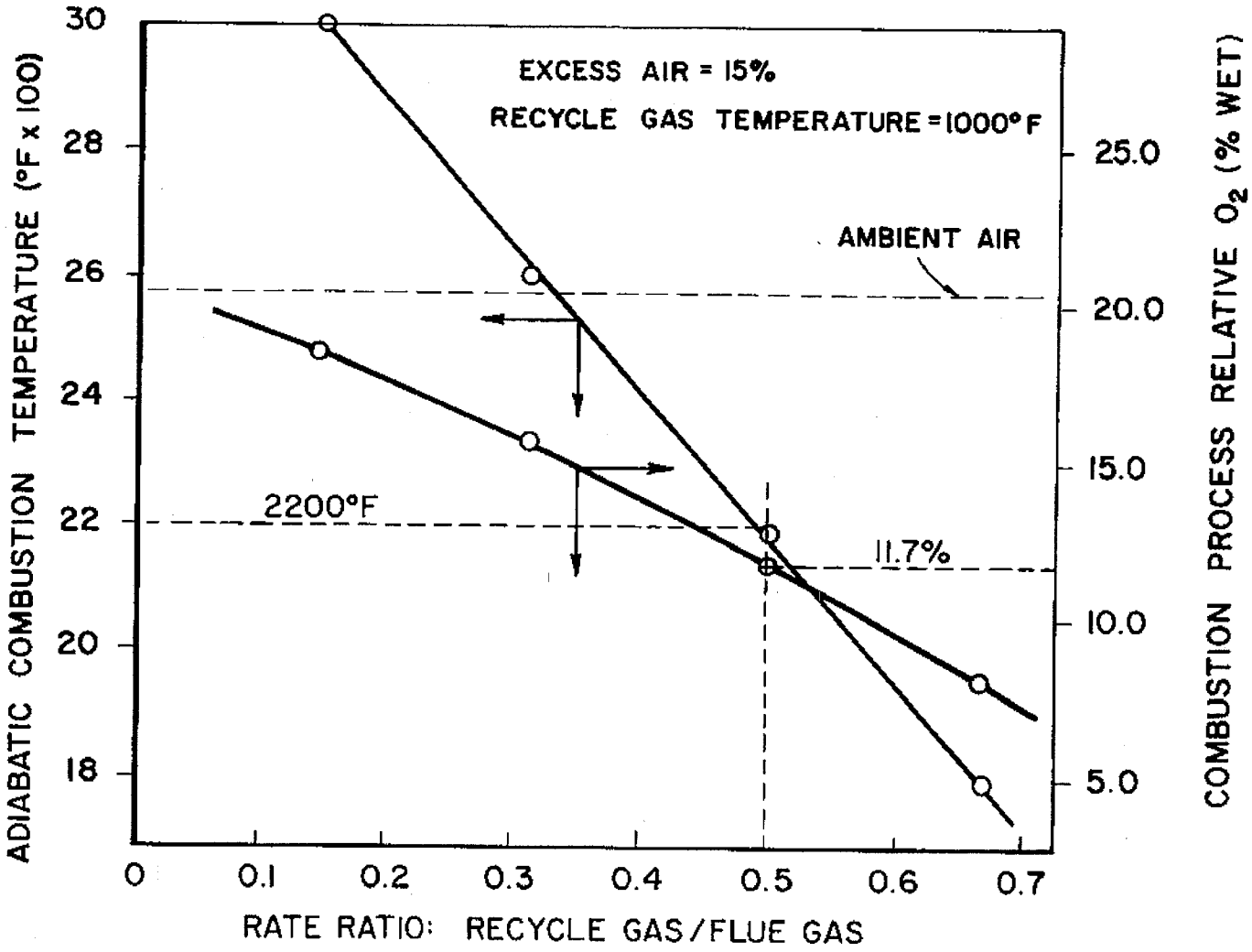
FIG. 4 is a graph showing adiabatic combustion process temperature and relative oxygen as a function of the rate ratio of recycle gas to flue gas.

FIG. 4 entitled "Combustion Process Temperature And Relative Oxygen" is a plot of adiabatic combustion temperature and combustion process relative $O_2$ versus the rate ratio of recycle gas to flue gas. This figure suggests that in designing a burner it is appropriate to decrease the combustion temperature to achieve the required equilibrium $NO_x$. However, the amount of cooling, such as provided by recycle gas, is limited because a flame zone that becomes "to cold" will cease to support combustion. This minimum temperature is approximately 2200° F., which limits the minimum equilibrium $NO_x$.

FIG. 4 shows the effect of the ratio of recycle gas rate to flue gas rate on combustion temperature and relative $O_2$ concentration. The relationship is that as the portion of recycle gas increases, both the temperature and relative $O_2$ of the combustion process decreases. For example, the combustion process temperature is approximately 2200° F. and the amount of $O_2$ present in the combustion process is approximately 11.7% on a wet basis for a recycle gas ratio of 0.5, as opposed to 21% in normal combustion air with no recycle.

With this background which illustrates the major parameters that affect the production of $NO_x$ during gas combustion, reference will now be made to FIGS. 5 and 6 that illustrate the improved burner of this disclosure.

The improved burner, with its swirling, turbulent, segmented, and detached combustion causes maximum flame stability, allowing the local combustion process to occur at a lower temperature and with less concentration of $O_2$ than the current generation of low $NO_x$ burners.

Figure 5:
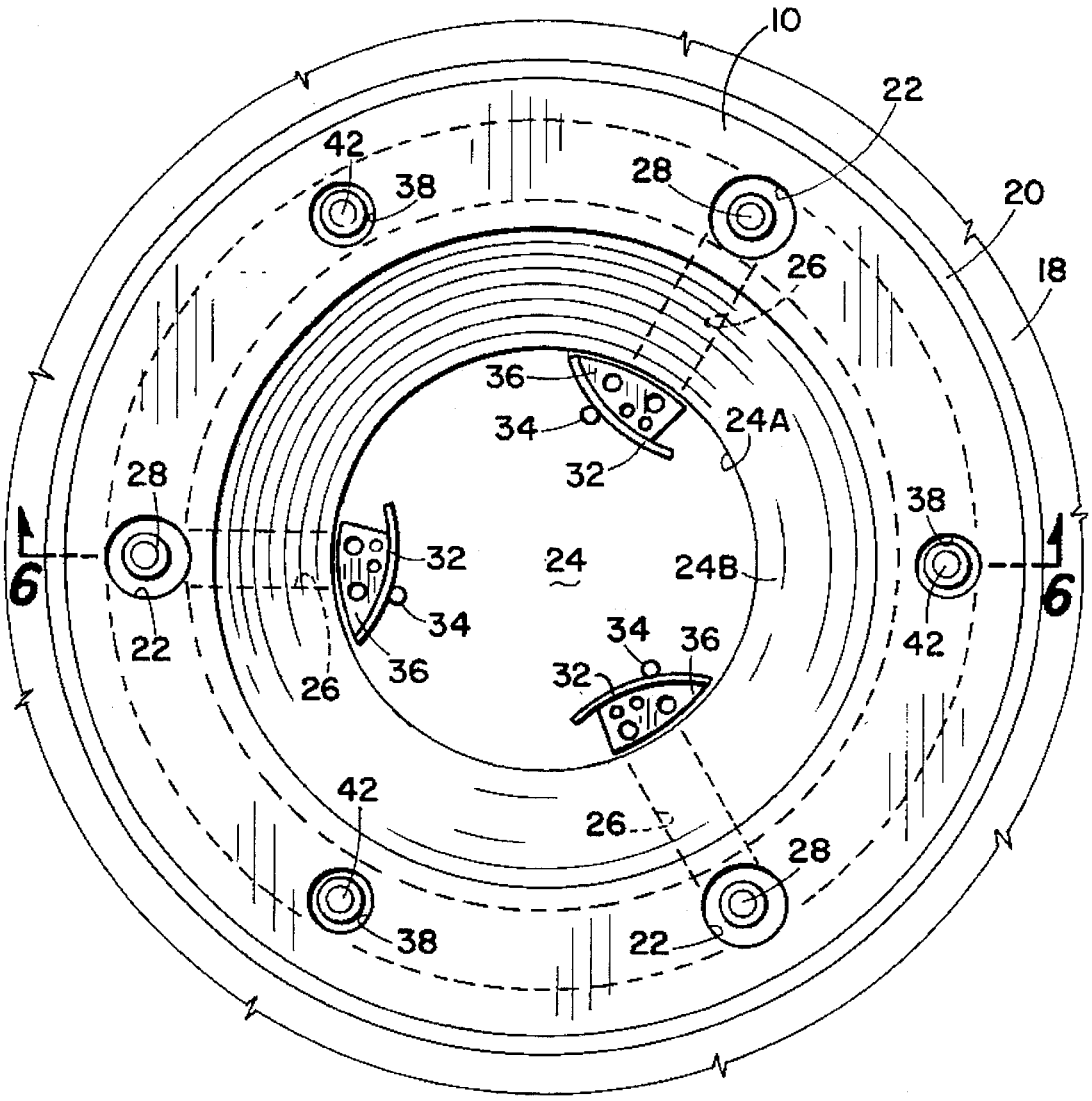
Figure 6:
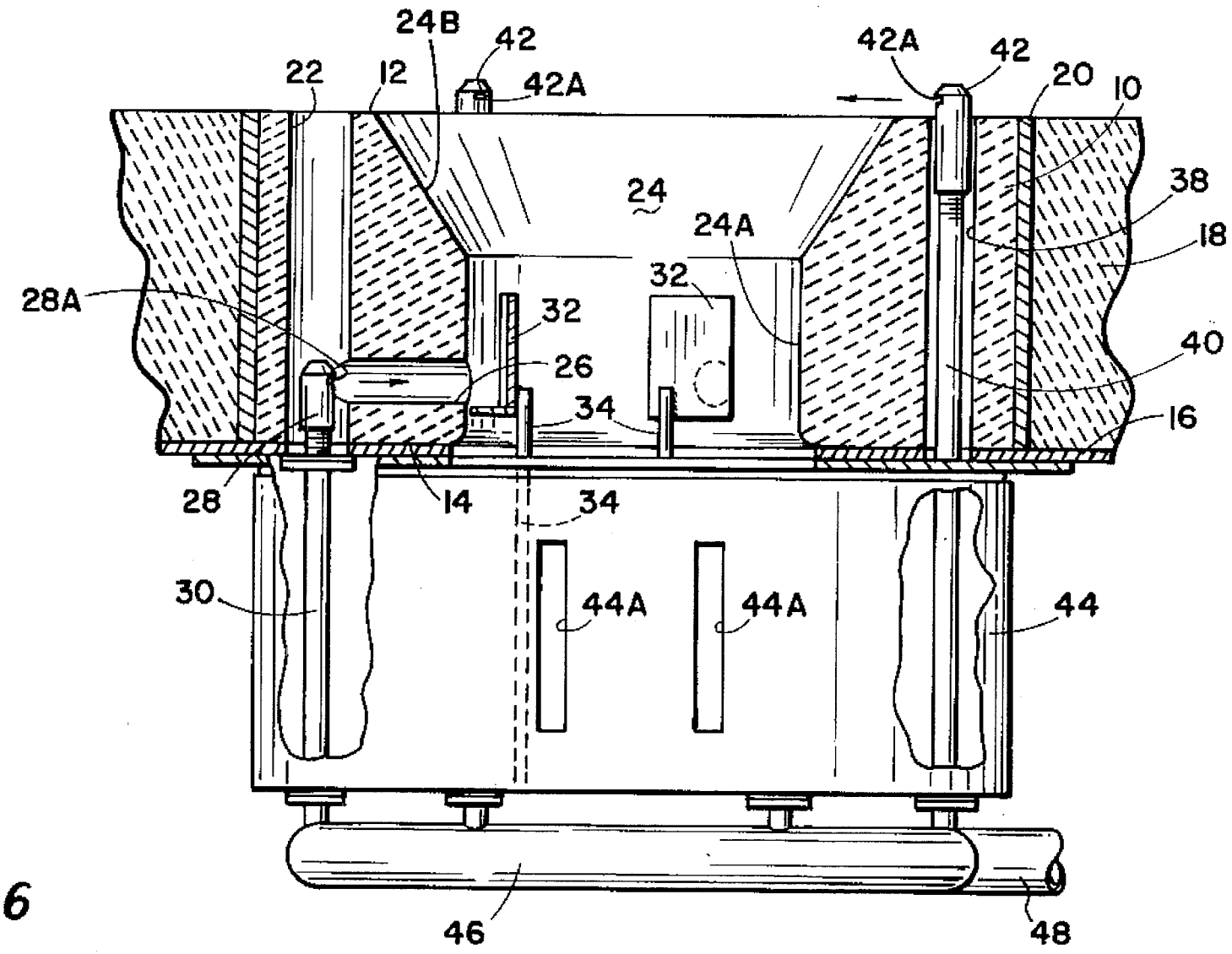
FIG. 6 is a cross sectional view of the burner as taken along the line 6—6 of FIG. 5.

Referring to FIGS. 5 and 6, a burner block is indicated by the numeral 10. Block 10 is preferably formed of a ceramic material, that is, a material that will stand high temperatures without deterioration. Burner block 10 has a outlet end 12 and an inlet end 14. Outlet end 12 is in communication with the interior of an enclosure in which combustion takes place. In the embodiment shown in FIG. 6, the enclosure is shown with a wall 16 that may be formed of metal. Insulating material 18 is secured to the interior of wall 16. In the illustrated arrangement, insulating material 18 is of a thickness equal to that of burner block 10. While the equal thickness of the insulating material and burner block may be considered a preferred arrangement, this does not mean that the burner must be employed in an environment in which insulating material is equal to the thickness of the block, as the block could project into the interior of the enclosure wherein combustion occurs. Block 10 is not limited to being of a cylindrical configuration, and for structural support of the burner block a metal sleeve 20 may be employed. And for protection from thermal compression, a compression layer may be employed between the burner block and the insulating material 18 of the enclosure.

Formed in the block are a plurality of recirculation gas passageways 22. In the embodiment illustrated there are three such recirculation gas passageways, although the number can vary according to the diameter of the block. These recirculation gas passageways are spaced from and paralleled to a central opening 24 formed in the block. Central opening 24 is preferably formed of two parts as illustrated, that is, a first cylindrical portion 24A that communicates with block inlet end 14 and a second frustoconical (which could also be cylindrical) portion 24B that communicates with block outlet end 12.

Each of the recirculation gas passageways 22 communicates with an injection passageway 26. Specifically, each injection passageway 26 communicates at one end with a recirculation gas passageway 22 and at the other end with the central opening 24.

Positioned within each of the recirculation gas passageways 22 is a primary fuel gas jet tip 28 connected to a conduit 30. Each primary fuel gas jet tip 28 has a jet opening(s) 28A oriented to direct gas into the injection passageway 26. Primary fuel gas jet tips 28 inject fuel gas through injection passageway 26 into central opening 24 wherein the fuel gas is mixed with recycle gas and this mixture is then mixed with air to provide a combustible mixture that is burned within the enclosure.

Supported within central opening 24, and specifically within the cylindrical portion 24A of the passageway, are a plurality of gas directors 32, there being a gas director 32 for each of the injection passageways 26. Each gas director 32 is formed of an outwardly extending preferably arcuate curved plate, as seen best in FIG. 5. The gas directors are positioned to intersect gas passing out of the injection passageways and to cause the gas to move in a turning direction within central opening 24. Each gas director 32 is supported by a rod 34 or like device. In addition, a perforated bottom plate 36 serves to augment the outward mixing motion of air and gas within central opening 24.

Fuel gas injected into the injection passageway 26 causes, by the Bernoulli effect, the recirculation of gases from the interior of the enclosure through recirculation gas passageways 22, the recirculated gas passing with the injected fuel gas through injection passageways 26 and into burner block central opening 24. These recirculation gases are from the outer fringes of the combustion zone, which are cooler and serve to minimize combustion temperature and thereby minimize the amount of $NO_x$ production.

Formed within block 10 are spaced apart secondary fuel gas jet tip passageways 38, there being three such openings in the illustrated embodiment. These passageways are spaced from and paralleled to central opening 24 and are also spaced from and paralleled to recirculation gas passageways 22. In the preferred arrangement as illustrated, secondary fuel gas jet tip passageways 38 are interspaced between the recirculation gas passageways 22.

Positioned in each of the staged fuel gas jet tip passageways 38 is a fuel gas conduit 40 having at the upper end thereof a fuel gas jet tip 42. Each of the tips 42 has a jet opening(s) 42A oriented to direct fuel gas into the enclosure at a selected angle. One example of such selected angle is indicated by the arrow across the outlet end 12 of block 10 in the direction towards central opening 24.

In the operation of the burner of this invention, air is drawn through central opening 24 so that air passes from the exterior of the enclosure to the interior and as it passes into the interior, is thoroughly admixed with fuel gas by the burner so that substantially complete combustion occurs within the enclosure. To control air into and through central opening 24, a tubular skirt 44 is provided, the skirt being concentric with central opening 24. The skirt has openings 44A therein to permit passage of air into the interior of the skirt and thence into central opening 24.

Positioned below tubular skirt 44 is a fuel gas manifold 46 which is shown toroidal in shape and is in communication with conduits 30 and 40. A gas supply conduit 48 extends from the manifold to a gas source.

The means of directing air through the burner is not specifically illustrated since such is standard procedures in the industry. For one example of a method of directing air through a burner, reference may be had to U.S. Pat. No. 5,073,105 entitled "Low $_{NOx}$ Burner Assemblies". This patent provides a burner in the same environment as the present invention, but it functions in a different way from the present invention.

Figure 11:
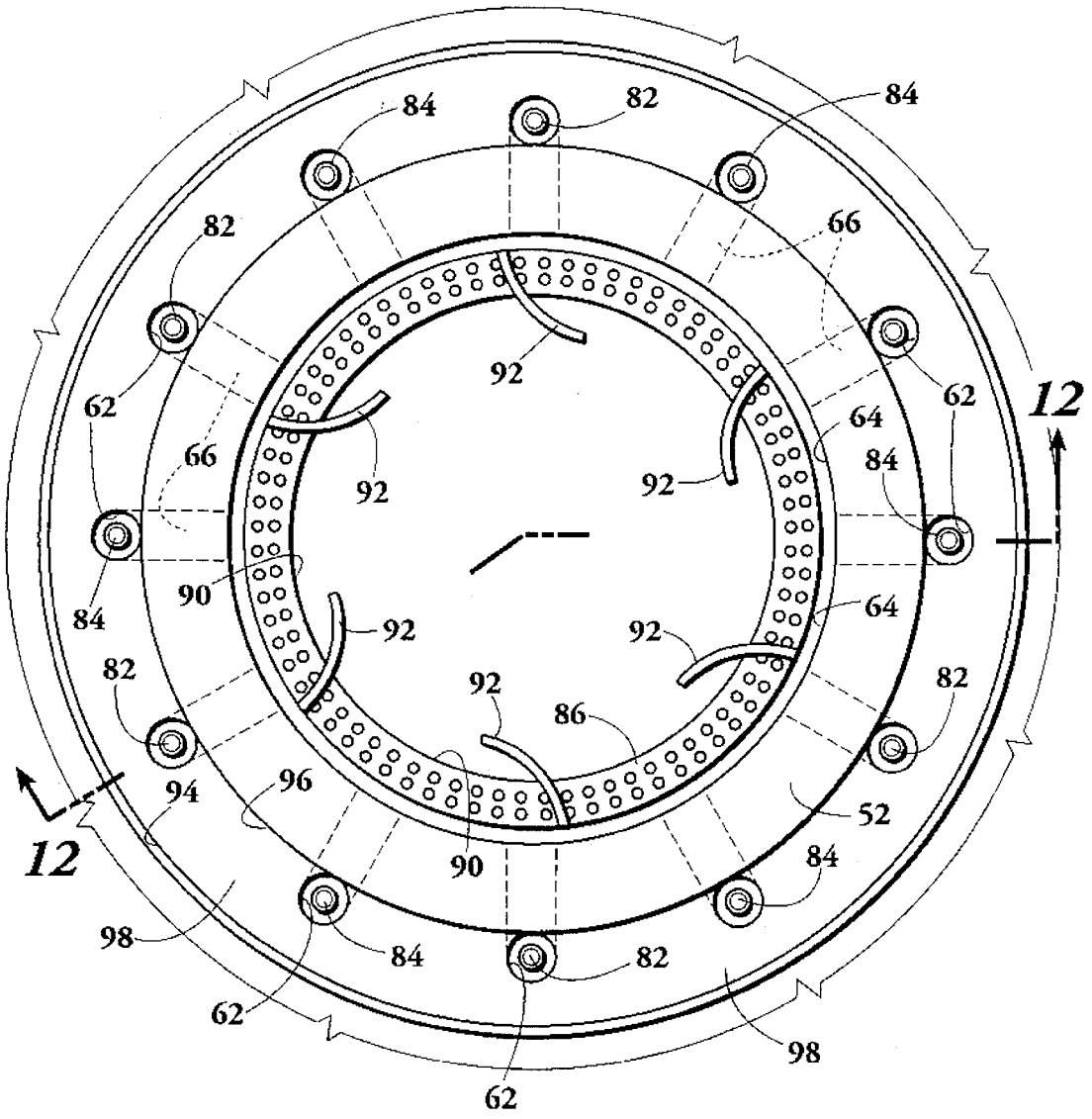
FIG. 11 is a cross sectional elevational view as shown in FIG. 8 but showing the burner arranged to employ gaseous fuel only.
Figure 12:
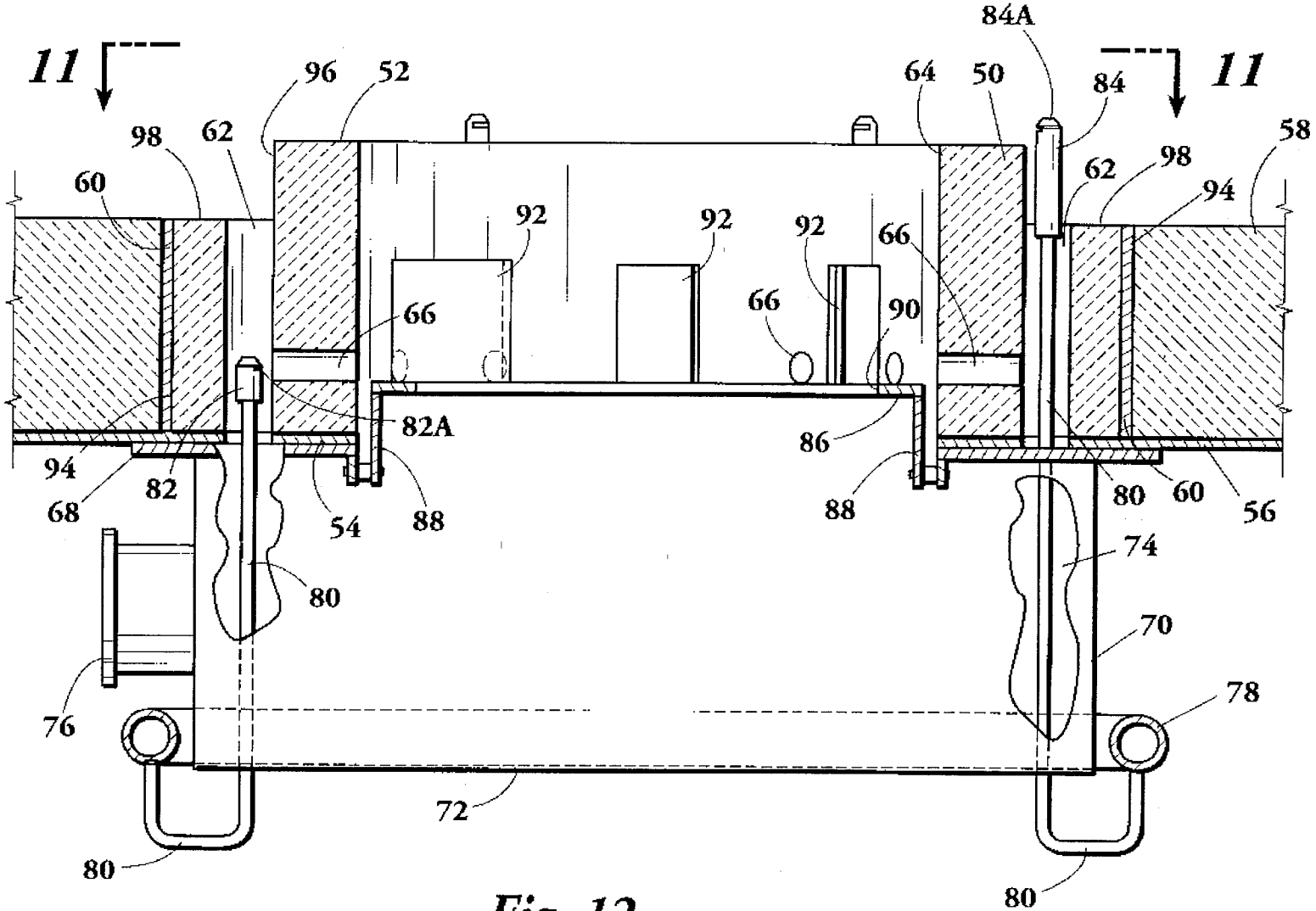
FIG. 12 is a plan view as taken along the line 12—12 of FIG. 11.

A modified and improved burner for burning gas as a fuel is illustrated in FIGS. 11 and 12. A burner block 50, that is preferably formed of a ceramic material, has a top end 52 and a bottom end 54. Burner block 50 is positioned within the interior of a wall 56 that forms an enclosure to be heated by the burner. Surrounding burner block 50 is insulation material 58 that serves to retain heat within the confines of the enclosure and to protect wall 56. Burner block 50 is illustrated as being cylindrical which is a convenient shape but the burner block could be of other shapes, such as square or rectangular, if desired. For structural support of burner block 50 a metal sleeve 60 may be employed. While not shown, for protection from thermal compression, a compression layer may be employed between burner block 50 and insulating material 58.

Formed in the block are a plurality of recirculation gas passageways 62. These recirculation gas passageways are spaced from and parallel to a central opening 64 formed in burner block 50.

Each of the recirculation gas passageways 62 communicates with an injection passageway 66. The lower ends of recirculation gas passageways 62 are closed, such as by wall 56 or by a plate 68.

Supported to the bottom end 54 of burner block 50 is a cylindrical skirt 70 having a closed bottom 72 forming an interior plenum chamber 74. A conduit 76 communicates with plenum chamber 74. Air employed in the burning process is injected through conduit 76 and into plenum chamber 74 where it passes through burner block central opening 64. The arrangement employing a closed cylindrical skirt 70 with an air inlet 76 is typical of burners that use a forced draft system, that is, where air is forced into the burner rather than an induction system as has been described with reference to FIGS. 5 and 6.

Surrounding skirt 70 is a gas manifold 78 having a plurality of gas supply conduits 80 extending from it. Positioned within a portion of the recirculation gas passageways is a primary gas jet 82 having connected to it a gas supply conduit 80. Each primary gas jet 82 has a jet opening 82A oriented to inject gas directly into an injection passageway 66.

Positioned within another portion of the recirculation gas passageways 62 is a gas conduit 80 having connected at the upper end thereof a secondary gas jet 84. Each secondary gas jet 84 has a gas jet opening 84A. Each gas jet opening 84A is oriented to jet gas across burner block top surface 52 and thereby across the outlet end of burner block central opening 64. The angle at which gas is jetted relative to top surface 52 by gas jet openings 84A can vary.

In the preferred arrangement gas jets 82 are alternated with gas jets 84, that is, each of the recirculation gas passageways 62 has a gas jet therein, alternating between a jet 82 aligned with an injection passageway 64 and a gas jet 84 that injects gas over the outlet end of burner central openings 64, as illustrated in FIG. 12.

Positioned within burner block central opening 64 is an annular flame director ring 86. The flame director ring may be supported by brackets 88 that are, in turn, attached to plate 68. Flame director ring 86 has a central opening 90 therethrough that is centrally positioned within burner block opening 64.

Positioned on and supported by flame director ring 86 are a plurality of gas directors 92. Gas directors 92 are aerodynamically configured to cause fuel gas and recirculation gas entering burner block central opening 64 through the injection passageways 66 to swirl within opening 64. This swirling action increases the mixture of recirculated gas and fuel gas with air within central passageway 64.

Flame director ring 86 has two important functions. First, it provides means for physically supporting gas deflectors 92 within the interior of the burner block central opening 64. Second, gas deflector ring 92 creates a Venturi effect that improves the burner performance. Air entering the burner central passageway 64 from skirt 70 passes through flame director ring central opening 90 and then, into the increased internal diameter passageway of burner block opening 64. This creates a Venturi effect, that is, a pressure drop occurs as air passes through gas deflector ring central opening 90. The reduced pressure caused by this Venturi action augments the recirculation of gas through recirculation gas passageway 62 and injection passageways 64 so that an increased volume of gas is recirculated within the burner. This recirculation of gas cools the flame temperature and more thoroughly mixes the air and the fuel to thereby produce heat with a lower $NO_x$ production.

The configuration of burner block 50 of the embodiment of FIGS. 11 and 12 is improved by amendments to the burner block external configuration. The new burner block design has an external circumferential surface 94 adjacent the bottom end 54 that is greater in diameter than the smaller external surface 96 that is adjacent the block top end 52. The difference in diameter between portions 94 and 96 creates circumferential ledge 98. Recirculation gas passageways 62 communicate with circumferential ledge 98. This produces two important results. First, by the provision of ledge 98 the length of each recirculation passageway 62 is reduced, thereby reducing pressure drop resulting in increasing gas recirculation through recirculation passageways 62 and injection passageways 66. The second benefit of the provision of ledge 98 is that it moves the opening to the recirculation gas passageways 62 away from burner block top end 52 so that gas drawn into the recirculation gas passageways is spaced from and slightly isolated from the outlet of central opening 64 where primary combustion takes place. This means that the gas recirculated through recirculation gas passageways 62 is taken from an area of reduced gas temperature. Therefore, the cooling effect of the recirculated gas is increased.

Figure 9:
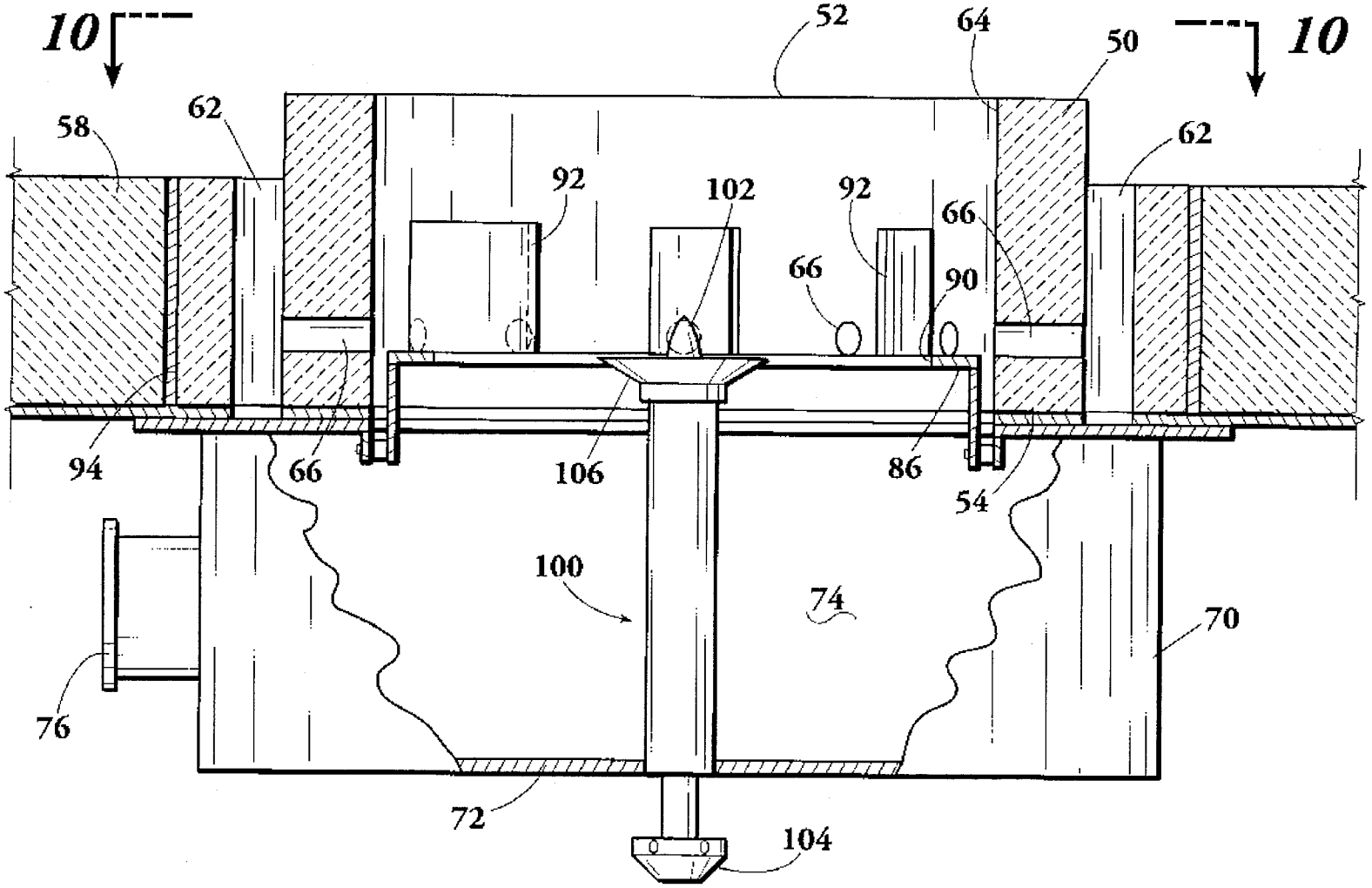
FIG. 9 is a cross sectional elevational view as shown in FIG. 8 but showing the burner as employed to burn liquid fuel only.
Figure 10:
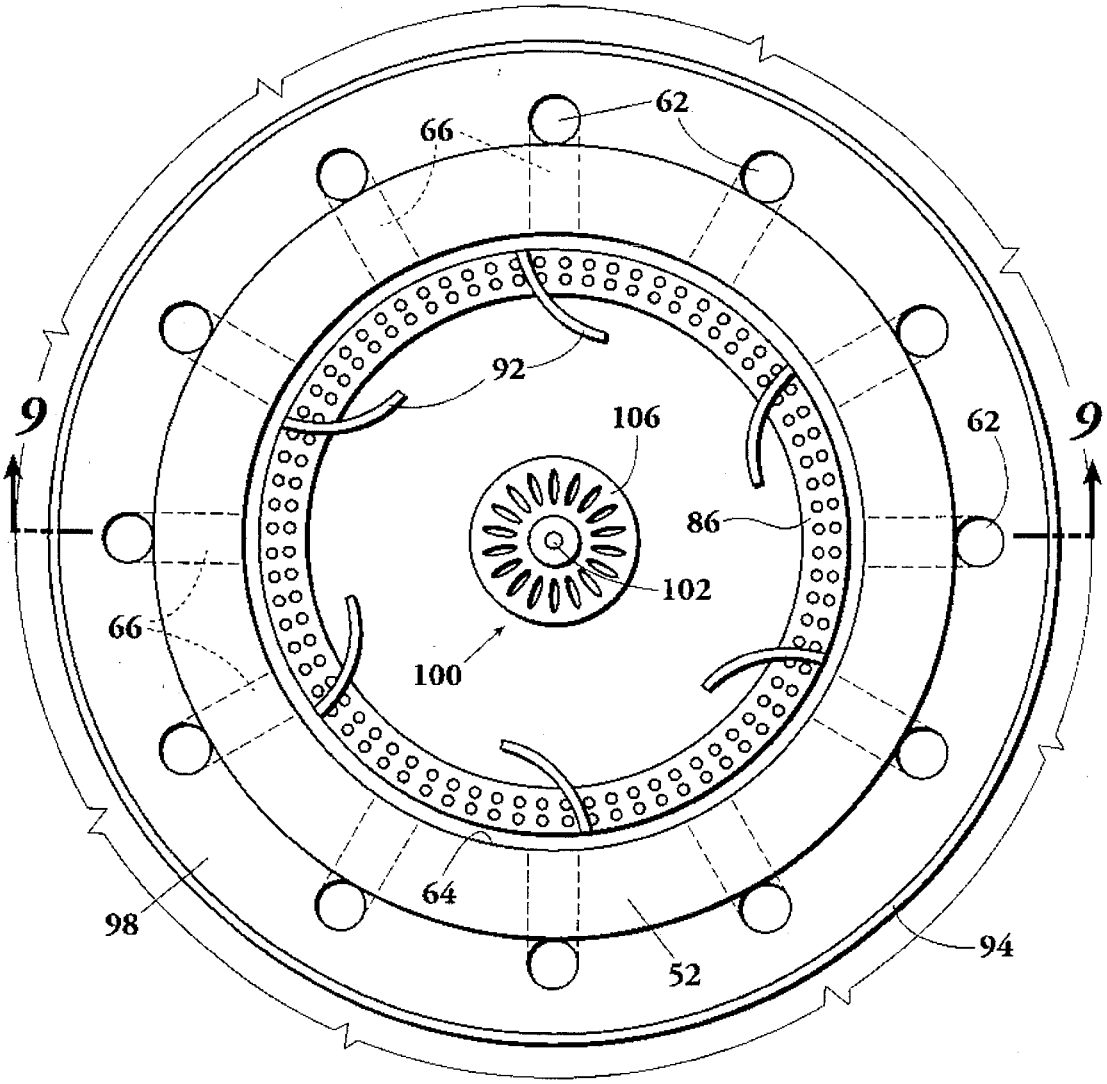
FIG. 10 is a plan view as taken along the line 10—10 of FIG. 9.

The improved burner that has been described with reference to FIGS. 11 and 12 may be employed to burn liquid fuel only in the arrangements as illustrated in FIGS. 11 and 12. In FIGS. 9 and 10 the burner block, including the cylindrical skirt 70 forming plenum chambers 74 and the flame director ring 86 all have the same construction and function as previously described. In addition, in this embodiment the provision of a circumferential ledge 98 on the exterior of the burner block is the same and for the same advantages as previously described. In FIGS. 9 and 10 gas jets are not employed, only an oil gun generally indicated by the numeral 100 is used to supply fuel for the burner. The oil gun extends centrally through plenum chamber 74. The upper end of the oil gun provides a liquid fuel nozzle 102. At the lower end of the fuel gun is an oil body receiver 104. By conduit, not shown, liquid fuel is conveyed to fuel atomizer and from fuel gun 100 is discharged or sprayed out through liquid fuel nozzle $1O_2$ into burner block central opening 64. The atomized liquid fuel is mixed with air forced into skirt 70 through conduit 76 to provide a combustible mixture. The burning mixture is cooled by the recirculation of gas through recirculation gas passageways 62 and injection passageways 66 as previously described.

The function of the flame director ring 86 to support gas deflectors 92 is the same as previously described with reference to FIGS. 11 and 12 and the Venturi effect caused by gas director ring 96 is the same. To augment the Venturi effect, oil gun 100 has, at the upper end thereof, immediately below liquid fuel nozzle 102, a diffuser cone 106. The external diameter of diffuser cone 106 is less than central opening 90 in flame director ring 86. Thus, the diffuser cone 106 and flame director ring central opening 90 provide an annular air passageway into the lower end of burner block central opening 94 causing an improved Venturi action to thereby augment the recirculation of gas through recirculation passageways 62 and injection passageways 66.

Figure 7:
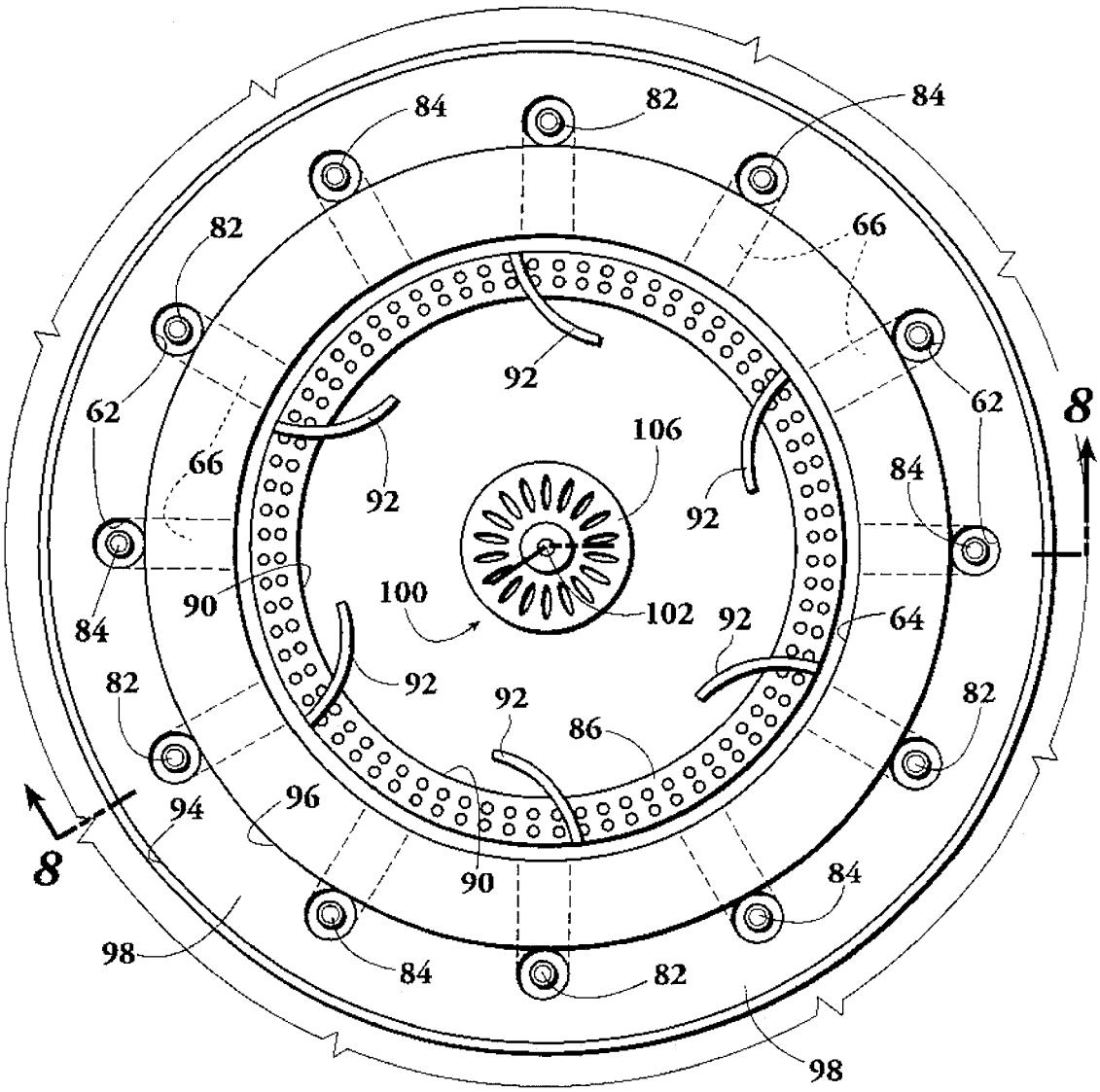
FIG. 7 is a top plan view of an improved burner design. The burner of FIG. 7 is capable of burning fuel in the form of gas or liquid or a combination of both gas and liquid. The burner of FIG. 7 is a forced draft type in which air is forced into the burner and a modified burner block is illustrated having a stepped external configuration.
Figure 8:
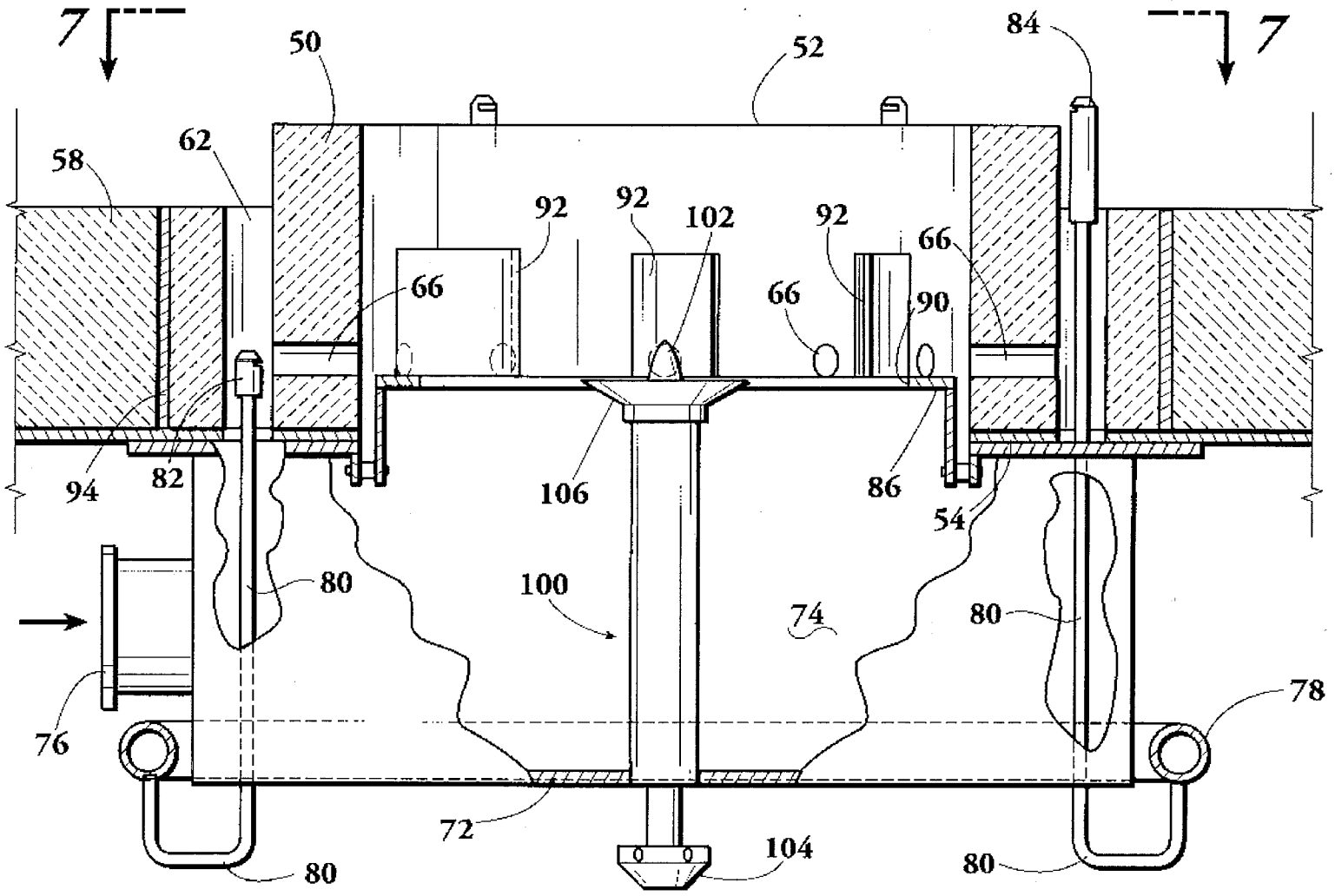
FIG. 8 is an elevational cross-sectional view as taken along the line 8—8 of FIG. 7 showing the relationship of a flame director ring supported within the burner block central opening and the oil gun diffuser cone.

FIGS. 7 and 8 illustrate the embodiment of the invention wherein the burner is configured to bum both gas and liquid fuels. Thus, FIGS. 7 and 8 show a combination of the gas fuel burner of FIGS. 11 and 12 and the liquid fuel burner of FIGS. 9 and 10. The combined fuel burner of FIGS. 7 and 8 has all of the advantages previously described for the gas fuel burner as well as for the liquid fuel burner combined in one operating unit and provides a combination gas and liquid fuel burner that results in reduced $NO_x$ emissions.

Figure 13:
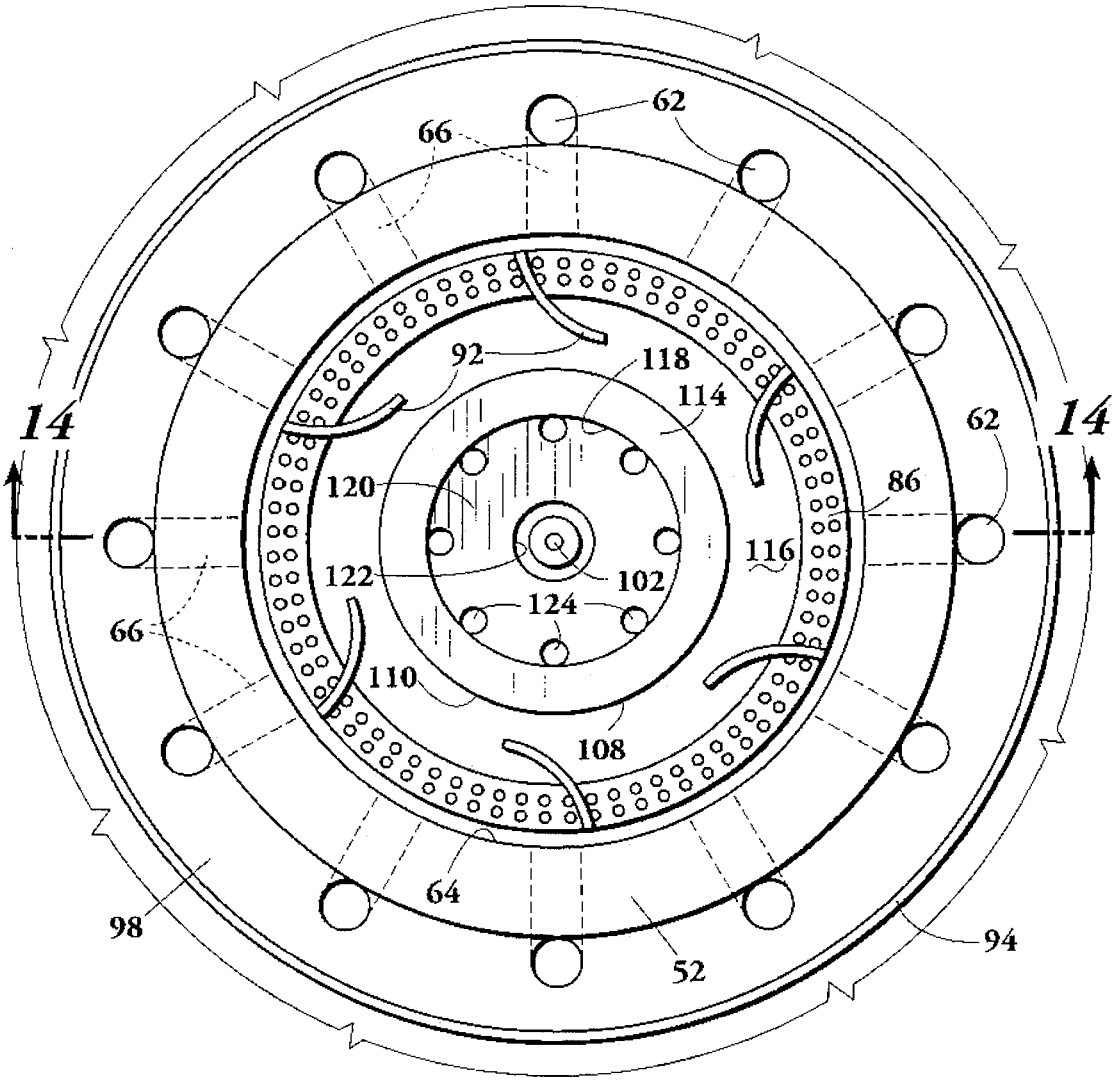
FIG. 13 is a top plan view of an alternate embodiment of the improved burner design. The burner of FIG. 13 is specifically illustrated as adapted for combusting liquid fuel although the burner can be adapted to also burn gaseous fuel in a manner as described with reference to FIGS. 7 and 8. The burner of FIG. 13 employs a primary block positioned concentrically within the lower end of the burner block. The functions of the primary block are: (1) to provide for primary combustion of liquid fuel; (2) to provide for flame rekindling and (3) for augmenting the Venturi effect achieved by the flame director ring.
Figure 14:
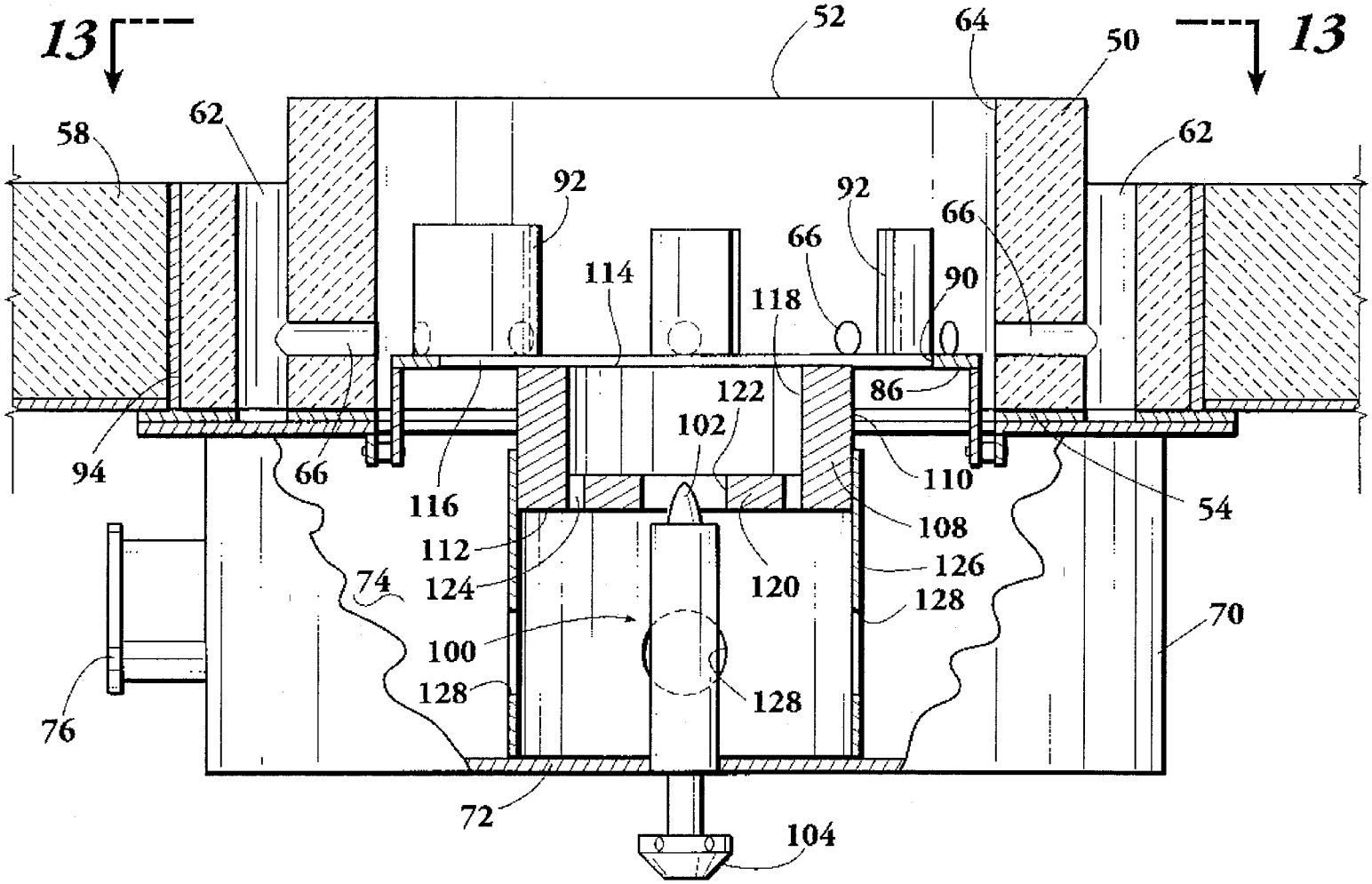
FIG. 14 is an elevational cross-sectional view taken along the line 14—14 of FIG. 13 showing the relationship between the primary block and the flame director ring. This figure also shows the use of an oil gun positioned to inject liquid fuel into the primary block.

Referring to FIGS. 13 and 14 another alternate embodiment of the invention is shown and may be particularly be considered an alternate embodiment of the invention as illustrated and described with reference to claims 9 and 10. As with the embodiment of claims 9 and 10, the embodiment of FIGS. 13 and 14 is a burner particularly designed for burning liquid fuel utilizing forced draft. In this embodiment, a primary block 108 is centrally positioned within the lower end of the central opening of burner block 50. Primary block 108 is formed of ceramic material and is of external diameter 110 less than the internal diameter 64 of burner block 50 and, in the illustrated and preferred embodiment, is of external diameter less than central opening 90 of flame director ring 86. Primary block 108 has an inlet end 112 and outlet end 114. Outlet end 114 is preferably at least in substantial alignment with flame director ring 86 to provide an annular air passageway 116 therebetween. The restriction formed by the annular passageway 116 augments the Venturi effect achieved by flame director ring 86, the Venturi effect serving to increase the recirculation of gases through recirculation passageways 62 and injection passageways 66.

Primary block 108 has a central opening 118 that communicates with the outlet end 114. An integral flange portion 120 is formed at inlet end 112. Integral flange portion 120 has a central opening 122 and a plurality of smaller diameter openings 124 spaced from the central opening. Central opening 122 and smaller openings 124 provide passageways for the flow of air therethrough.

Centrally positioned within cylindrical skirt 70 is an oil gun, generally indicated by the numeral 100, having an oil body receiver 104 at the lower end through which liquid fuel is injected into the burner. Liquid fuel nozzle $1O_2$ extends within primary block central opening 122. Atomized liquid fuel is injected into primary block 108 from nozzle 102.

A tubular metal can 126 positioned within the plenum chamber 74 formed by skirt 70 serves to support primary block 108. Air passageways 128 are formed in metal can 126 by which air flows from plenum chamber 74 to pass through primary block openings 122 and 124.

Primary block 108 has a variety of functions. First, central opening 118 provides an area of primary combustion. Second, it augments the Venturi effect of flame director ring 86 to increase the circulation of gases through passageways 62 and 66 to reduce the $NO_x$ production. Third, when heated to ignition temperature by the combustion of fuel within central opening 118, it serves to rekindle the burner flame in the event of inadvertent flameout. Thus, in the embodiment of FIGS. 13 and 14, primary block 108 achieves improved Venturi action comparable to that of diffuser cone 106 of FIG. 9 and, in addition, provides an area of primary combustion and a flame regenerator.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A burner for combusting fuel and air comprising:

a burner block having an inlet end and an outlet end and a central opening therethrough between the ends, the burner block outlet end being in communication with an enclosure to be heated by burning fuel, and the burner block having a plurality of spaced apart recirculation gas passageways communicating with said burner block inlet, the recirculation gas passageways being at least generally paralleled to and spaced from said central opening and having an injection passageway communicating each recirculation gas passageway with said central opening, recycled gas being drawn from said burner block outlet end and recycled back into said central opening through said recirculation gas passageways and said injection passageways;

a toroidal flame director ring positioned within said central opening in said block;

means for injecting fuel into said burner block central opening; and means to move primary combustion air into said burner block central opening at said inlet end, recycled gas being mixed with primary combustion air and fuel in said central opening, the recycled gas serving to cool a flame produced at said burner block outlet end, said toroidal flame director ring serving to cause a Venturi effect to increase the flow of recycled gas.

2. A burner for combusting fuel and air according to claim 1 including a plurality of flame director means supported by said flame director ring oriented to cause a swirling action of gas and fuel with said burner block central opening oriented to support local primary combustion and then to cause a mixing action of gas and air passing into said central opening.

3. A burner for combusting fuel and air according to claim 1 including:

said burner block has a plurality of spaced apart secondary fuel gas jet openings therein extending between said inlet and outlet ends, the secondary fuel gas jet openings being at least generally paralleled to and spaced from said central opening;

a gas conducting conduit received in at least some of said recirculation gas passageways; and a fuel jet member affixed to each said gas conducting conduit and extending slightly beyond said outlet end of said burner block and having means to inject gas across said outlet end of said block.

4. A burner for combusting fuel and air according to claim 3 wherein said secondary fuel gas jet openings and said recirculation gas passageways are alternately spaced in at least generally paralleled relationship with each other.

5. A burner for combusting fuel and air according to claim 1 wherein said central opening in said block is defined by a first substantially cylindrical portion communicating with said block inlet end and a second concentric portion communicating with said block outlet end.

6. A burner for combusting fuel and air according to claim 5 wherein said second concentric portion of said central opening in said block is frustoconical.

7. A burner for combusting fuel and air according to claim 1 wherein said block has a cylindrical external surface and including:

a tubular skirt member supported at said block inlet end concentrically with said block central opening.

8. A burner for combusting fuel and air according to claim 7 wherein said tubular skirt member has means to receive the inflow of combustion air under pressure.

9. A burner for combusting fuel and air according to claim 3 including:

a gas manifold positioned in close proximity to and spaced from said burner block inlet end and wherein each of said fuel jet members has communication with said gas manifold.

10. A burner block for combusting fuel and air according to claim 1 including:

a primary block supported concentrically within said burner block central opening, the primary block having an external dimension less than said burner block central opening and having an inlet end and an outlet end, the outlet end being substantially co-planar with said flame director ring and having a central opening therethrough;

a liquid fuel nozzle positioned within said primary block central opening providing at least a portion of said means for injecting fuel into said burner block.

11. A burner for combusting fuel and air comprising:

a burner block having an inlet end and an outlet end and a central opening therethrough between the ends, the burner block outlet end being in communication with an enclosure to be heated by burning fuel, the block having a plurality of spaced apart recirculation passageways communicating with the block outlet end, the recirculation passageways being generally paralleled to and spaced from said central opening and the burner block having an injection passageway communicating each recirculation passageway with said central opening;

an annular flame director ring positioned within said central opening and spaced between said injection passageways and said burner block inlet end;

a flame director supported on said flame director ring in alignment and with each said injection passageways; and means for injecting fuel into said burner block central opening, recycled gas being drawn through said recirculation gas passageways and injection passageways, said flame directors being oriented to cause recycled gas to whirl within said block central opening.

12. A burner according to claim 11 wherein said means for injecting fuel into said burner block central opening includes means of injecting gas into said injection passageways.

13. A burner according to claim 11 wherein said means for injecting fuel includes means of injection liquid fuel into said burner central opening from a liquid fuel nozzle positioned centrally within said central opening.

14. A burner according to claim 13 in which said annular flame director ring has a central opening therein concentric with but of smaller diameter than said central opening in said burner block and wherein said liquid fuel nozzle includes a diffuser cone that is substantially co-planar with said flame director ring and of external diameter less than said flame director ring central opening providing an annular air inlet space communicating with said burner block central opening that is of cross-sectional area less than said block central opening.

15. A burner according to claim 11 wherein said means for injecting fuel into said burner block central opening includes means wherein at least some of said recirculation passageways have a gas conduit therein; and a fuel jet member affixed to each said conduit and extending slightly beyond said outlet end of said block and having means to inject gas across said outlet end of said block.

16. A burner according to claim 11 wherein said burner block has an external cylindrical surface concentric with said circular opening, the diameter of the external surface being greater at said inlet end and smaller at said outlet end providing a circumferential ledge, and wherein at least some of said recirculation passageways communicate between said circumferential ledge and said injection passageways.

17. A burner block for combusting fuel and air according to claim 11 including:

a primary block supported concentrically within said burner block central opening, the primary block having an external dimension less than said burner block central opening and having an inlet end and an outlet end, the outlet end being substantially co-planar with said flame director ring and having a central opening therethrough;

a liquid fuel nozzle positioned within said primary block central opening providing at least a portion of said means for injecting fuel into said burner block.

* * * * *